US010276968B2

(12) United States Patent
Herbrechtsmeier et al.

(10) Patent No.: US 10,276,968 B2
(45) **Date of Patent: *Apr. 30, 2019**

(54) HOLDING FRAME FOR PLUG CONNECTOR MODULES

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/755,042

(22) PCT Filed: May 30, 2016

(86) PCT No.: PCT/DE2016/100249

§ 371 (c)(1),
(2) Date: Feb. 23, 2018

(87) PCT Pub. No.: WO2017/036439

PCT Pub. Date: Mar. 9, 2017

(65) Prior Publication Data

US 2018/0241149 A1 Aug. 23, 2018

(30) Foreign Application Priority Data

Sep. 3, 2015 (DE) ..... 10 2015 114 696
Sep. 3, 2015 (DE) ..... 10 2015 114 703

(51) Int. Cl.
*H01R 13/514* (2006.01)
*H01R 13/518* (2006.01)
(Continued)

(52) U.S. Cl.
CPC ..... *H01R 13/518* (2013.01); *H01R 13/506* (2013.01); *H01R 13/508* (2013.01); *H01R 13/514* (2013.01)

(58) Field of Classification Search
CPC ..... H01R 13/514
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 201656162 U 11/2010
CN 202084755 U 12/2011
(Continued)

OTHER PUBLICATIONS

German Office Action, dated Aug. 5, 2016, for German Application No. 10 2015 114 703.3, 4 pages (no English translation provided).
(Continued)

*Primary Examiner* — Phuong K Dinh
(74) *Attorney, Agent, or Firm* — Seed IP Law Group LLP

(57) ABSTRACT

The disclosure relates to a holding frame in which plug connector modules can be inserted. The holding frame comprises two interconnectable halves which can be aligned relative to each other in two positions. The holding frames comprise at least one fixing means and the halves can be fixed to each other by means of the at least one fixing means in at least two positions. The fixing means are at least one locking element and/or at least one press fit lug which engages in at least one cavity.

18 Claims, 8 Drawing Sheets

(51) Int. Cl.
*H01R 13/506* (2006.01)
*H01R 13/508* (2006.01)

(58) Field of Classification Search
USPC ..... 439/701, 540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A * | 12/1999 | Harting | H01R 13/518 439/532 |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 | 5/2013 | Feist et al. | |
| 8,668,530 | B2 | 3/2014 | Riepe et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 * | 2/2017 | Herbrechtsmeier | H01R 13/518 |
| 9,608,374 | B2 | 3/2017 | Beischer et al. | |
| 9,847,608 | B2 | 12/2017 | Bruex et al. | |
| 9,923,307 | B2 | 3/2018 | Beischer et al. | |
| 2005/0070146 | A1 | 3/2005 | Lu | |
| 2006/0035501 | A1 | 2/2006 | Lewis et al. | |
| 2007/0155252 | A1 | 7/2007 | Ferderer | |
| 2010/0159728 | A1 | 6/2010 | Wang et al. | |
| 2014/0179171 | A1 | 6/2014 | Mortun et al. | |
| 2018/0026405 | A1 | 1/2018 | Schlepp et al. | |
| 2018/0248296 | A1 | 8/2018 | Herbrechtsmeier et al. | |
| 2018/0248297 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254577 | A1 | 9/2018 | Herbrechtsmeier et al. | |
| 2018/0254578 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

German Office Action, dated Aug. 10, 2016, for German Application No. 10 2015 114 696.7, 8 pages (no English translation provided).
International Search Report and Written Opinion, dated Aug. 10, 2016, for International Application No. PCT/DE2016/100249, 10 pages (with English translation of Search Report).
Harting Elektronik GmbH, "Schwere Steckverbinder Han-Modular®," Product Catalog, Jan. 1999, 44 pages.
International Preliminary Report on Patentability, dated Mar. 6, 2018, for International Application PCT/DE2016/100249, 15 pages. (with English Translation).
Written Opinion of the International Search Authority, dated Aug. 10, 2016, for International Application No. PCT/DE2016/100249, 7 pages. (English Translation).

* cited by examiner

HOLDING FRAME FOR PLUG CONNECTOR MODULES

BACKGROUND

Technical Field

The disclosure relates to a holding frame for plug connector modules.

Such holding frames serve for supporting plug connector modules, the holding frame being fitted with various plug connector modules and then being inserted into a plug connector housing and being screw-connected to said plug connector housing. In this case, the holding frame has to be mechanically robust in order to be able to withstand the insertion and withdrawal forces occurring when the plug connection is connected or disconnected.

Description of the Related Art

DE 19 707 120 C1 discloses a holding frame for plug connector modules. The holding frame consists of two halves which are interconnected by means of a joint. Latching hooks of the plug connector modules engage in recesses of the side faces of the respective half. The joint or the end-face joints are arranged in the fastening ends of the holding frame. When the holding frame is screwed onto a fastening face, the frame parts are aligned in such a manner that the side parts of the holding frame are aligned at right angles to the fastening face. As a result, the plug connector modules are fixed in the holding frame.

The holding frame of DE 19 707 120 C1 has no clearly defined open position for fitting the holding frame with plug connector modules. Consequently, on occasion, assembly is somewhat unwieldy, in particular in the case of untrained persons.

Once the holding frame has been successfully fitted with plug connector modules, it has to be moved into a closed state or into a closed position so that the plug connector modules are fixed. There is no fixed closed state for the closed state of the holding frame of the prior art such that the holding frame can inadvertently open, as a result of which the modules can fall out of their securement.

No defined electric contact exists between the halves of the holding frame as a result of a mere flexible connection. As a result, the holding frame cannot be utilized for grounding purposes.

BRIEF SUMMARY

Embodiments of the present invention provide a holding frame which is simple to handle and is versatile in use.

The holding frame according to an embodiment of the present invention is provided for the purpose of receiving plug connector modules. The holding frame is then installed into a plug connector housing or screwed onto a wall surface, for example of a machine.

The holding frame comprises or consists of two interconnectable halves. Each of said halves comprises a side face and an end face. The two halves define more or less in their contact region a separation plane which extends parallel to the longitudinal side of the halves.

The halves are alignable with respect to one another in at least two positions. As a rule, the ability to align is realized by means of a flexible connection, which is described in more detail further below.

The holding frame comprises at least one fixing means or device and the halves are fixable with respect to one another in at least two positions, an open position and a closed position, by means of the at least one fixing means or device. In the open position, the holding frame can be fitted with plug connector modules. In the closed position, the plug connector modules are fixed in the holding frame and can no longer slip or fall out, for example when being installed in a plug connector housing.

The fixing means or device is advantageously at least one blocking element and/or at least one press lug which engages in at least one recess (10).

The term open position means that the halves are positioned with respect to one another along the separation line at an angle $\alpha$ not equal to 180°. The angle is preferably between 130° and 170°. An angle between 155° and 165° has proved to be particularly advantageous. With the halves at said angular position, the plug connector modules can be placed in a particularly easy manner into the holding frame. In the closed position, the halves assume an angle of approximately 180° or precisely 180° with respect to one another. The halves are therefore parallel to one another in the closed position.

The holding frame advantageously comprises a pivot point at each end, wherein the connecting line between the pivot points forms a rotational axis which extends parallel to the side faces of the halves. The halves of the holding frame can be rotated and aligned with respect to one another along the rotational axis. The pivot points are formed, as a rule, by a joint head which is guided in a matching joint receiving means and is described in more detail further below.

It is advantageous when a first half comprises at least one joint head and a second half comprises at least one joint receiving means which matches said joint head. The joint head of the first half is engageable in the joint receiving means of the second half, as a result of which a flexible connection between the halves is providable. The halves of the holding frame are alignable with respect to one another as a result of the flexible connection.

It is particularly advantageous when the first half comprises two joint heads which, as a rule, are arranged on the respective end faces of the half. The second half comprises two joint receiving means which match said joint heads and in which the joint heads of the first half are engageable. Two end-face joints provide the flexible connection with mechanical robustness.

In a particularly advantageous embodiment of the invention, a joint arm is integrally molded on the joint head or a joint arm is integrally molded on each of the joint heads. The joint arm is or the joint arms are connected to the first half or are integrally molded thereon. A press lug is integrally molded in each case on the joint arm or on the joint arms.

In an advantageous manner, the second half comprises two recesses in the region or in the vicinity of the joint receiving means or in each case two recesses in the region or in the vicinity of the respective joint receiving means. The press lug is pressable into the two recesses or the press lugs are pressable into each of the two recesses, as a result of which the halves are fixable with respect to one another in at least two positions, an open position and a closed position. As a result, reliable fixing of the joint frame in two positions, an open and a closed position, is achieved. The technical means required for this are integrally molded directly on the halves of the joint frame such that the holding frame proposed here, compared to the prior art, does not require any further components and nevertheless provides further advantages. The solution proposed here is simple and cost-efficient to realize.

The above-described fixing works by way of a so-called oversize pressing and is consequently particularly reliable.

The halves preferably consist of a metal material. In a closed state, the halves are in electrically conducting contact with one another. As a result, the joint frame can also be used for earthing purposes.

The function of a further fixing means or device, a so-called blocking element, is now explained in more detail below.

The holding frame according to an embodiment of the invention is provided for the purpose of receiving plug connector modules and of then being installed in a plug connector housing. The holding frame comprises or consists of two interconnectable halves, a first half and a second half. The holding frame comprises at least one first blocking element.

The halves are alignable with respect to one another in at least two positions and are fixable with respect to one another in at least two positions by means of the first blocking element. The ability of the halves to align is obtained by means of a flexible connection, which is described in even more detail further below.

The holding frame advantageously comprises a pivot point at each end, wherein the connecting line between the pivot points forms a rotational axis which extends parallel to the side faces of the halves. The halves of the holding frame can be rotated and aligned with respect to one another along the rotational axis. The pivot points are formed, as a rule, by a joint head which is guided in a matching joint receiving means and is described in even more detail further below.

The first blocking element preferably comprises an arcuate form. It could also be called a U-shaped form. One end of the blocking element is held on the first half and the other end of the blocking element is held on the second half.

It is particularly advantageous when the first blocking element is fastened on the halves under pretension and when, as a result of the pretension, a force is exerted which fixes the holding frame in an open position or in a closed position. The force which is applied as a result of the pretension is utilized for fixing the holding frame in a closed or an open position. When aligning the halves, the user has first of all to overcome a counter force until the holding frame remains in the respective position (open or closed) or is fixed in said position.

The force resulting from the pretension of the first blocking element acts on the end-face joints or on the end points of the rotational axis of the holding frame. Depending on in which alignment the holding frame is actually situated, a resulting force acts on the flexible connection and forces the holding frame into a closed or open position.

The holding frame preferably comprises at least one blocking element. A first blocking element is preferably arranged on an end face of the holding frame and a second blocking element is preferably arranged on the oppositely situated end face of the holding frame.

The first blocking element is situated in the inside of the first end face of the holding frame. The second blocking element is situated on the inside of the second end face of the holding frame. As a result, the alignment possibility of the holding frame is mechanically robust.

The second blocking element is preferably realized in a meander-shaped manner. Said meander shape supports the alignment movement of the halves.

It is particularly advantageous when the second blocking element is also fastened under pretension on the halves. Said pretension can support the fixing produced by the first blocking element.

The halves consist advantageously of a metal material. In a closed state, the halves are in electrically conducting contact with one another.

The electrically conducting connection between the halves can also be brought about or supported by the blocking element. The blocking element or the blocking elements may also consist of an electrically conducting material for this purpose.

The term open position means that the halves are positioned with respect to one another along the separation line at an angle $\alpha$ not equal to 180°. The angle is preferably between 130° and 170°. An angle between 155° and 165° has proved to be particularly advantageous. With the halves in said angular position, the plug connector modules can be placed in a particularly easy manner into the holding frame. In the closed position, the halves assume an angle of approximately 180° or precisely 180° with respect to one another. The halves are therefore parallel to one another in the closed position.

The two halves are moved reliably into electric contact with one another via the blocking element. This occurs, on the one hand, by the blocking element itself insofar as it is produced from an electrically conducting material. In addition, as a result of the pretension of the blocking element, the joint head of a half is pressed into the joint receiving means of the other half, as a result of which reliable electric contact is created.

In the case of embodiments of the present invention, the terms open or closed state and open or closed position are used synonymously.

BRIEF DESCRIPTION OF THE SEVERAL VIEWS OF THE DRAWINGS

Exemplary embodiments of the invention are shown in the drawings and are explained in more detail below. The drawings are as follows.

The figures include partially simplified, schematic representations. Sometimes, identical reference symbols are used for the same, but where applicable not identical elements. Various views of the same elements could be scaled differently.

DETAILED DESCRIPTION

Figure 1:
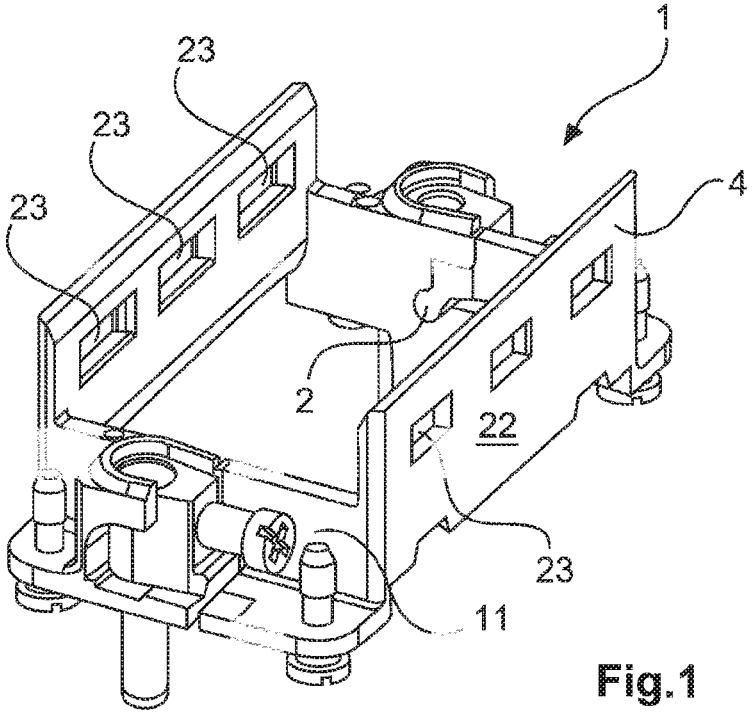
FIG. 1 shows a perspective representation of a holding frame.

Up to three plug connector modules 19 (FIG. 7) can be inserted into the example embodiments of the holding frame 1 shown in the drawings. Said number, however, is amendable. The number of plug connector modules 19 to be inserted can be increased correspondingly by extending the holding frame 1.

FIG. 1 shows a holding frame 1 in a closed position. The holding frame 1 comprises or consists substantially of two halves 4, 5 which are interconnected by means of a joint 2, 3. One half 5 comprises, to this end, on the respective end faces a joint head 2 which engages in a joint receiving means 3 of the oppositely situated half 4 provided for this purpose. This is known as a flexible connection between the two halves 4, 5 of the holding frame 1.

Figure 2:
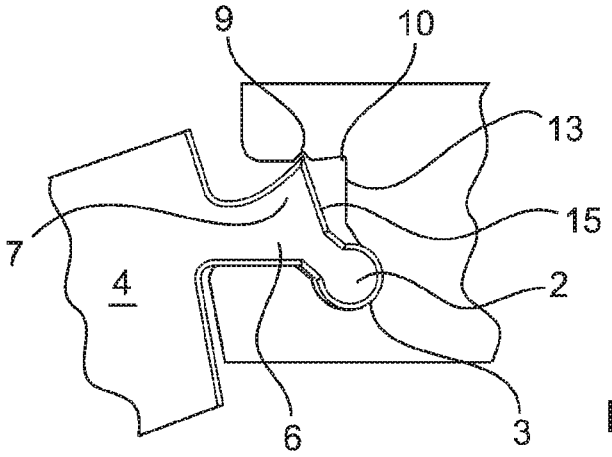
FIG. 2 shows a detail of a joint of a holding frame in an open position.
Figure 3:
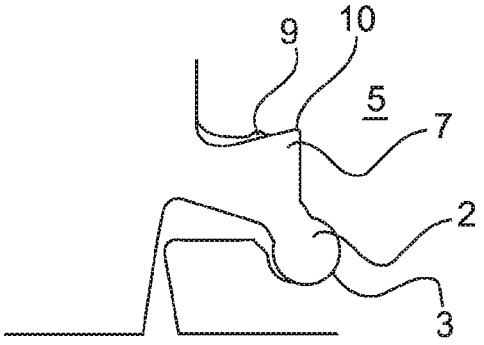
FIG. 3 shows a detail of a joint of a holding frame in a closed position.

FIGS. 2 and 3 show an enlarged detail in the region of a joint 2, 3 of the holding frame 1. The joint heads 2, 2' provided at the ends are integrally molded on the respective halves 4, 5 in each case by a joint arm. In each case, a so-called press lug 7, 7' is integrally molded on each of the respective joint arms 6, 6'. The joint head 2, the joint arm 6 and the press lug 7 together form approximately the shape of a flat cone.

The second half 5 of the holding frame 1 realizes in each case two recesses 9, 9, 10, 10' in the region of the flexible connection. All in all, four such recesses, each side includes two, are accordingly provided on the second half 5. The above-described press lugs 7, 7', which are integrally molded on the first holding frame 4, can engage in each of the two recesses 9, 9', 10, 10' or are pressable therein. As a result, the halves 4, 5 are fixable relative to one another in at least two positions, an open position (FIG. 2) and a closed position (FIG. 3).

Each end face 11, 12 of the holding frame 1 comprises two recesses, a first recess 9 and a second recess 10, in the region of the flexible connection. The above-mentioned press lugs 7, 7' can engage in the respective recess pairs 9, 10. If the press lugs 7, 7' are situated in the first recess 9, the holding frame 1 is fixed in an open position and can be fitted with plug connector modules 19. If the press lugs 7, 7' are situated in the second recess 10, the holding frame 1 is fixed in the closed position such that the plug connector modules 19 can no longer fall out and/or slip.

The open and closed position is secured in the holding frame 1 by stops. The second half 5 comprises a first stop 13 and a second stop 14 at each end. To this end, the joint frame 6 of the first half 4 comprises stops which correspond hereto, a first stop 15 and a second stop 16.

The above-mentioned stops are associated in each case with one half 4, 5 of the holding frame 1 and provide in each case an end position in the alignment of the holding frame 1. If the first stop 13 of the second half 5 abuts against the first stop 15 of the first half 4, the holding frame 1 is thus situated in the closed state. If the second stop 14 of the second half 5 abuts against the second stop 16 of the first half 4, the holding frame 1 is thus situated in the open state or in the open position.

The holding frame 1 comprises a grounding plug socket 24 in which a pin (not shown) of an oppositely situated holding frame (not shown) is able to engage.

Figure 7:
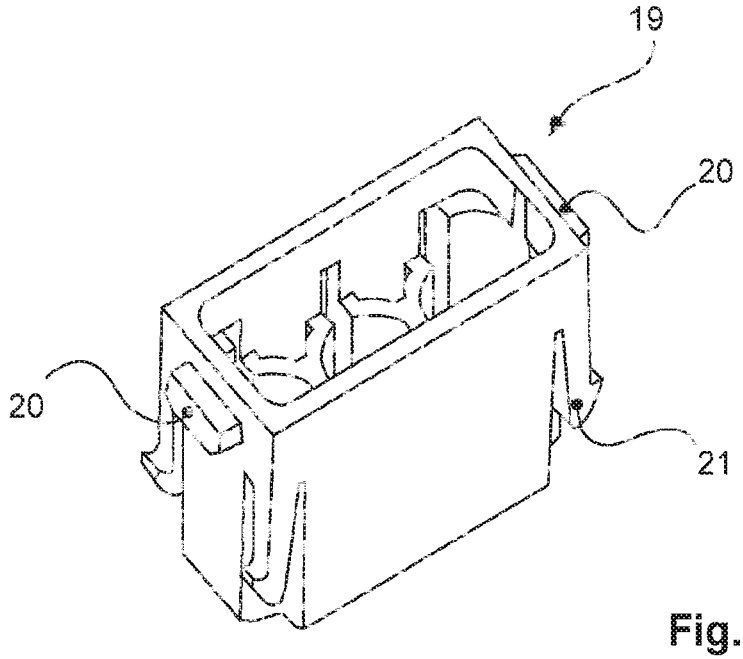
FIG. 7 shows a perspective representation of a plug connector module.

Plug connector modules 19 have been known for a long time and are described, for example, in DE 19 707 120 C1. The plug connector modules 19 are provided with protruding, approximately rectangular supporting means 20 and resilient latching hooks 21, as shown in FIG. 7. Recesses 23, which are realized as openings that are closed on all sides and into which the supporting means 20 enter when the plug connector modules 19 are inserted into the holding frame 1, are provided in the side parts 22 of the halves 4, 5, as shown, for example, in FIG. 1.

Figure 4:
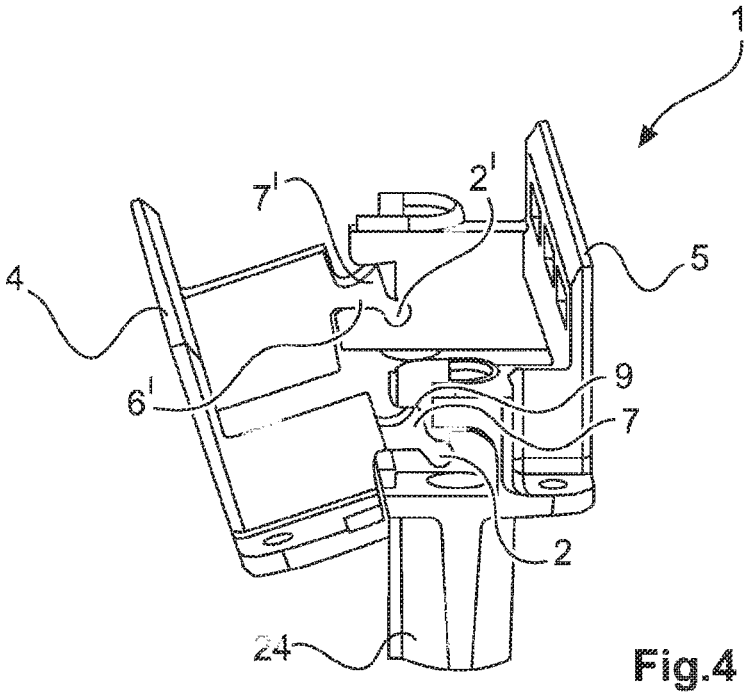
FIG. 4 shows a perspective representation of an open holding frame.

FIG. 4 shows the holding frame 1 in an open position. The end-side press lugs 7, 7' engage in the respective first recess 9, 9' of the second half 5. The holding frame 1 can be fitted with plug connector modules 19 (FIG. 7) in said position.

Figure 5:
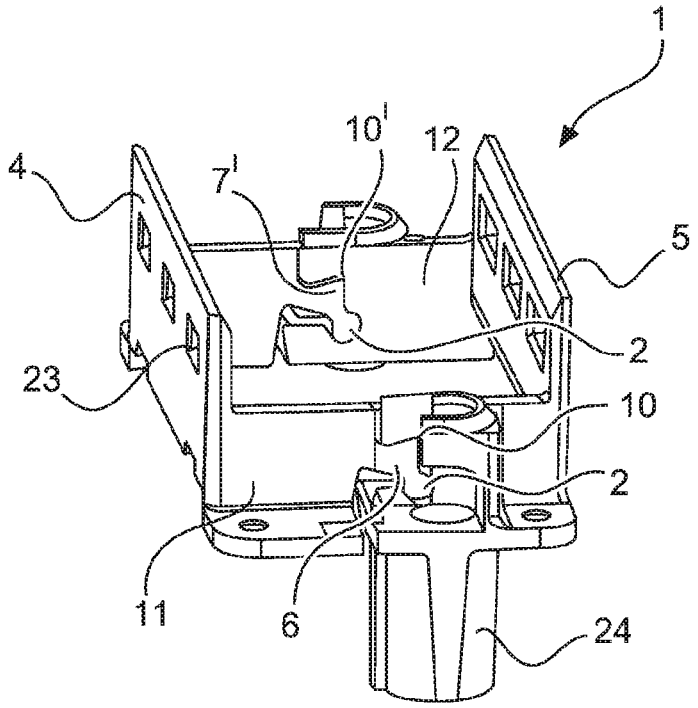
FIG. 5 shows a perspective representation of a closed holding frame.
Figure 6:
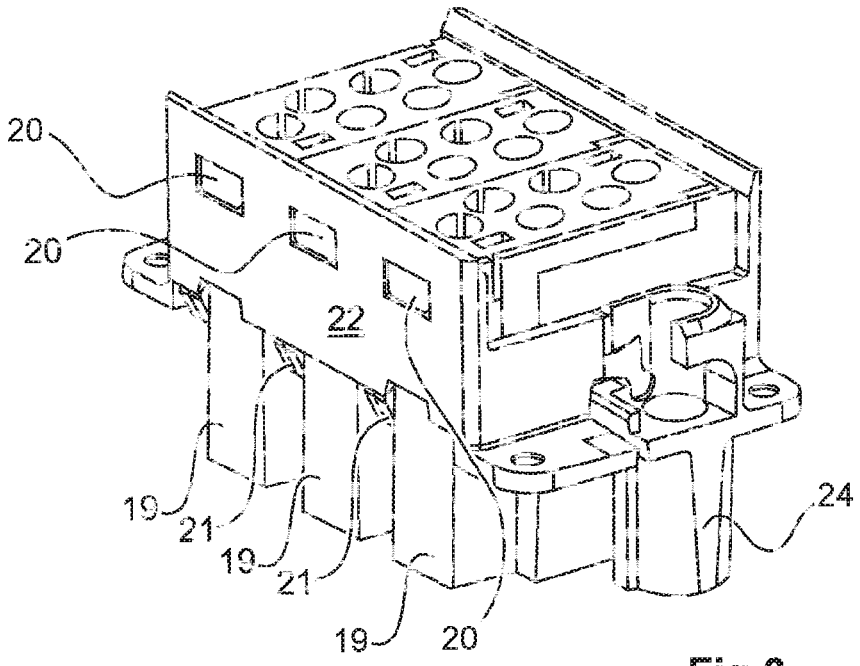
FIG. 6 shows a perspective representation of a holding frame fitted with plug connector modules.

FIGS. 5 and 6 show the holding frame 1 in a closed position. The end-side press lugs 7, 7' engage in the respective second recess 10, 10' of the second half 5. In said position, the plug connector modules 19 installed in the holding frame 1 can no longer slip and/or fall out.

In the case of the exemplary embodiment shown here, a press lug 7, 7' is provided at each end of the holding frame 1, that is to say a total of two press lugs. However, providing a press lug 7 only on one end face 11 of the holding frame 1 and leaving the other end face 12 with a classic joint would also suffice.

Embodiments of the invention relate to a holding frame 1 into which plug connector modules 19 are insertable, the holding frame 1 comprising or consisting of two interconnectable halves 4, 5, the halves 4, 5 being alignable with respect to one another in at least two positions, the holding frame 1 comprising at least one fixing means or device and the halves 4, 5 being fixable with respect to one another in at least two positions by the at least one fixing means or device. At least one press lug 7, preferably however two press lugs 7, 7', is/are integrally formed on the first half 4. The second half 5 comprises two recesses 9, 10 on an end face 11 or in each case two recesses 9, 9', 10, 10' on both end faces 11, 12 and the press lug 7 is pressable into the two recesses 9, 10 or the press lugs 7, 7' are pressable into each of the two recesses 9, 9', 10, 10', as a result of which the halves 4, 5 are fixable with respect to one another in at least two positions, an open position and a closed position.

Figure 8:
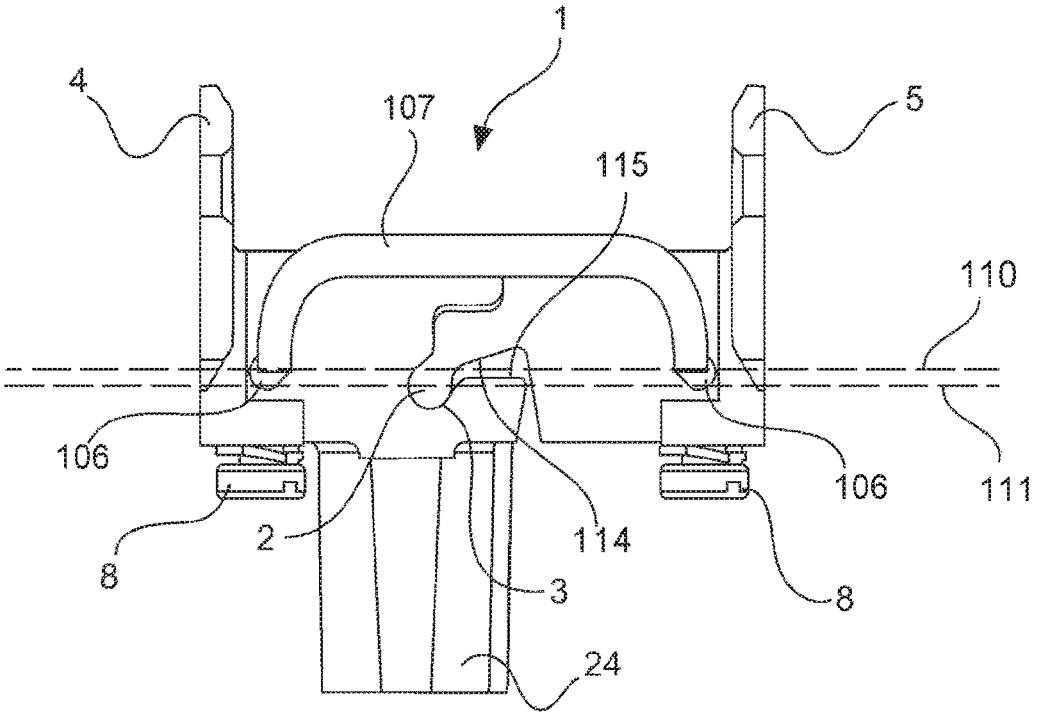
FIG. 8 shows a side view of a holding frame in a closed position.

FIG. 8 shows a holding frame 1 in a closed position. The holding frame 1 consists substantially of two halves 4, 5 which are interconnected by a joint 2, 3. To this end, one half 5 comprises, on the respective end faces, a joint head 2 which engages in a joint receiving means 3 of the oppositely situated half 4 which is provided for this purpose. This is referred to as a flexible connection between the two halves 4, 5 of the holding frame.

Figure 14:
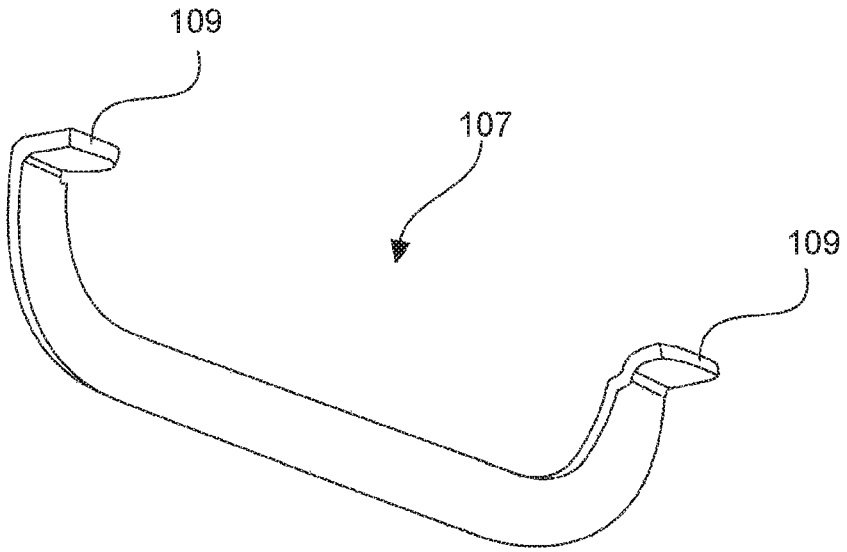
FIG. 14 shows a perspective representation of a first blocking element.

The holding frame 1 comprises a first blocking element 107 which is realized in a substantially U-shaped manner. The first blocking element 107 is shown in FIG. 14. The ends of the first blocking element 107 are bent around 90°. The bent regions form so-called latching hooks 9.

The halves 4, 5 of the holding frame 1 each comprise a recess 106. The latching hooks 109 of the first blocking element engage in the recesses 106, as a result of which the first blocking element 107 is fixed on the inside of an end face of the holding frame 1.

Figure 9:
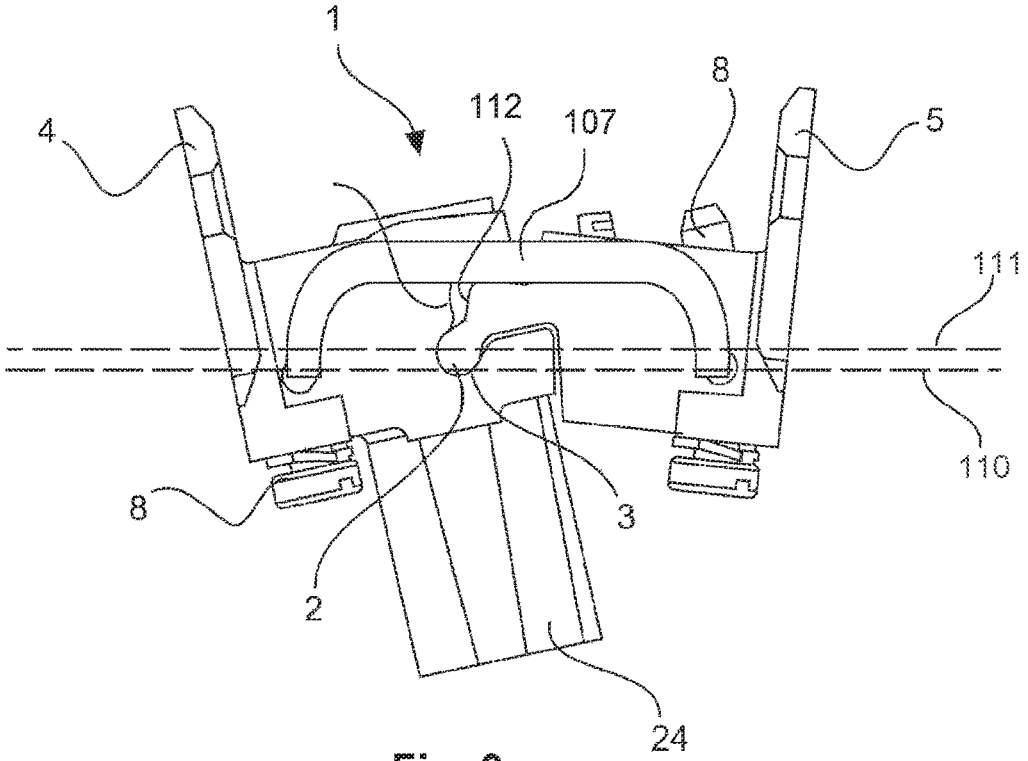
FIG. 9 shows a side view of a holding frame in an open position.
Figure 10:
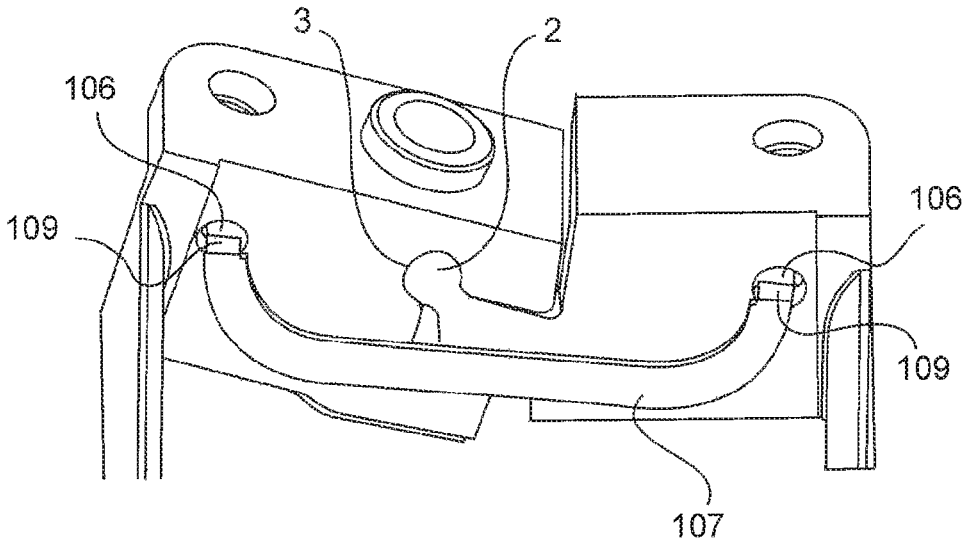
FIG. 10 shows a perspective representation of a detail of the holding frame.

The first blocking element 107 is inserted under pretension into the recesses 106. The ends of the first blocking element 107, as a result of the pretension, exert a force along a virtual clamping line 110 with respect to one another. FIGS. 8 and 9 show a center line 111 of the joint head 2 or of the flexible connection between the 4, 5 of the holding frame 1.

The method of operation of the first blocking element 107 is explained in more detail below. As a result of the pretension of the first blocking element 107, a force is exerted onto the flexible connection of the holding frame 1. A resultant force causes the halves 4, 5 to be positioned with regard to one another in a closed or open position.

If the clamping line 110 is situated above the center line of the joint 2, 3, the halves 4, 5 are guided with respect to one another into a closed position of the holding frame 1 (FIG. 8). In this case, a first stop 112, which proceeds from the joint head 2, is pressed against a first stop 113 of the half 4. If the clamping line 110 is situated below the center line 111, a second stop 114, which protrudes from the joint head 2, is pressed against a second stop 115 of the half 4. As a result, the halves 4, 5 or the holding frame 1 is/are fixed in an open position (FIG. 9).

Figure 11:
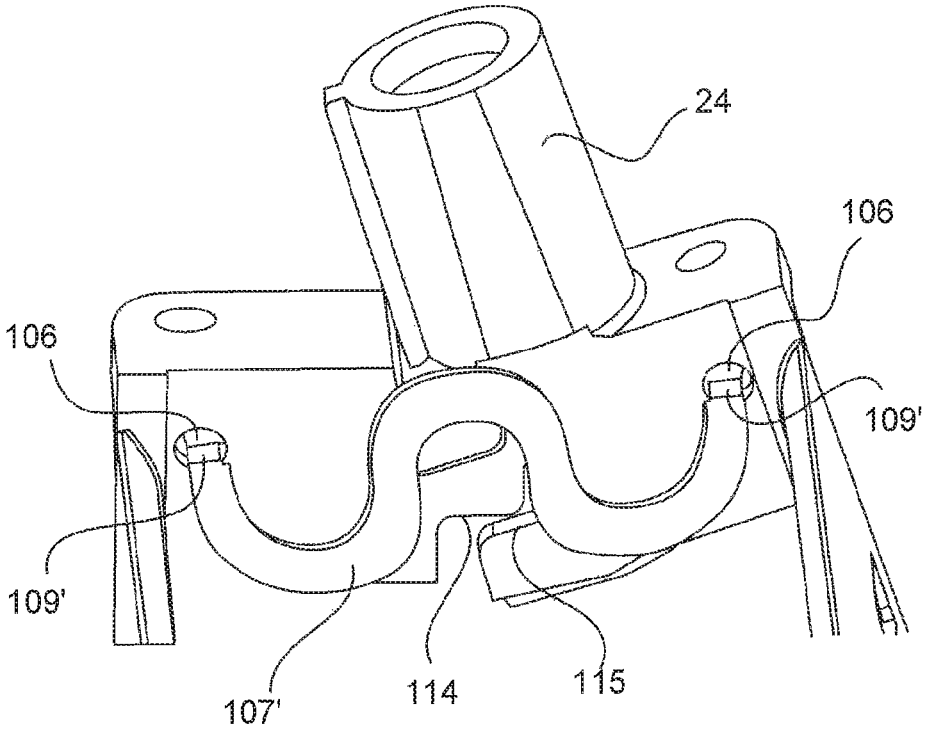
FIG. 11 shows a perspective representation of a further detail of the holding frame.
Figure 12:
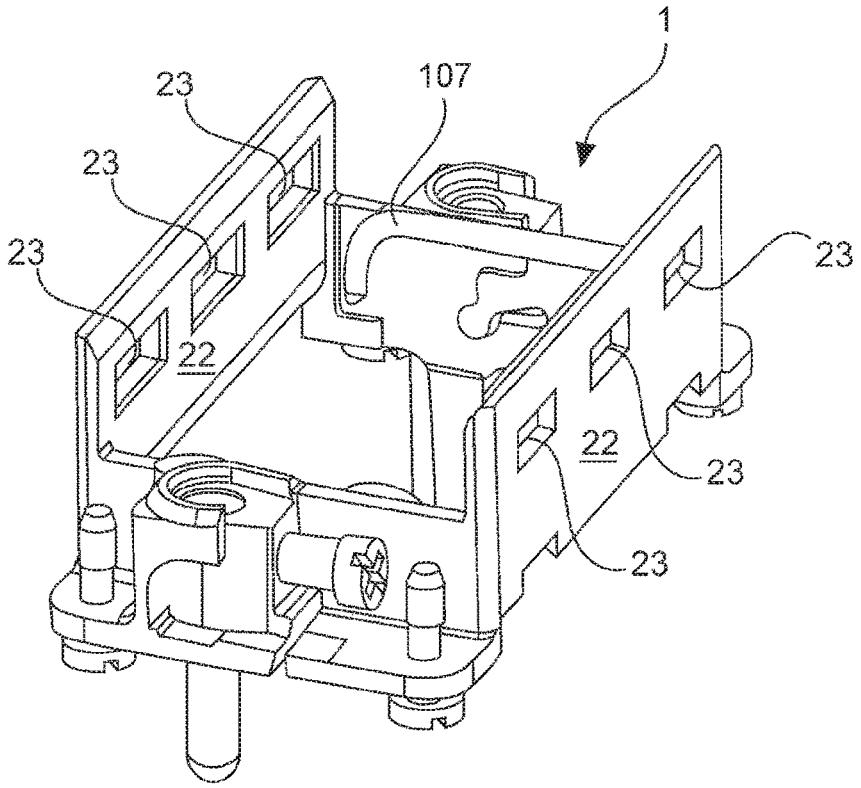
FIG. 12 shows a perspective representation of the closed holding frame.
Figure 13:
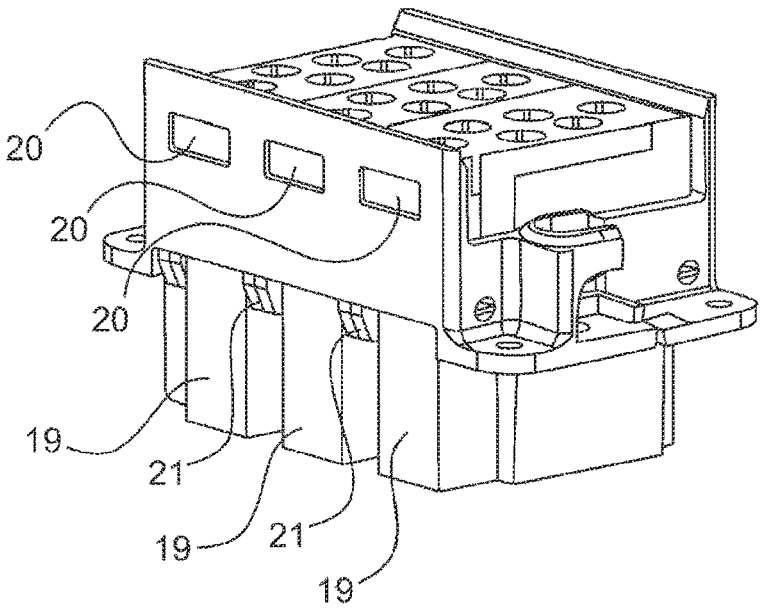
FIG. 13 shows a perspective representation of the closed holding frame with integrated plug connector modules.
Figure 15:
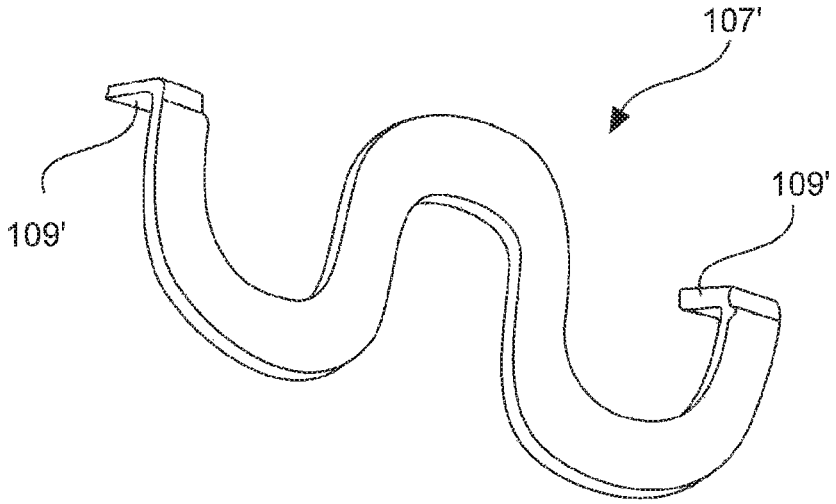
FIG. 15 shows a perspective representation of a second blocking element.

A second blocking element 107' (FIGS. 11 and 15) is fixed on an oppositely situated inner end face of the holding frame 1. Said blocking element 107 ' is configured in a substantially meander-shaped manner and, at the respective end, comprises latching hooks 109' which are held in recesses 106 on the halves 4, 5. A loop of the meander-shaped, second blocking element 107' is situated at the level of the joint 2, 3. The meander-shaped, second blocking element 107' supports the flexible connection between the halves 4, 5 in a substantial manner and provides a resetting force from the open to the closed position. As a result, the holding frame is able to be operated in an easier manner.

Plug connector modules 19 have been known for a long time and are described, for example, in DE 19 707 120 C1. The plug connector modules 19 are provided with protruding, approximately rectangular supporting means 20 and resilient latching hooks 21. Recesses 23, which are realized as openings that are closed on all sides and into which the supporting means 20 enter when the plug connector modules 19 are inserted into the holding frame 1, are provided in the side parts 22 of the halves 4, 5.

The holding frame 1 comprises a grounding plug socket 24 in which a pin (not shown) of an oppositely situated holding frame (not shown) is able to engage.

Embodiments of the invention relate to a holding frame 1 into which plug connector modules 19 are insertable, the holding frame 1 comprising or consisting of two interconnectable halves 4, 5, a first half 4 and a second half 5, the holding frame 1 comprising at least one first blocking element 107 and the halves 4, 5 being alignable and fixable with respect to one another in at least two positions by the first blocking element 107. The first blocking element 107 is fastened under pretension on the halves 4, 5 and a force, which fixes the holding frame 1 selectively in an open position or in a closed position, is exerted as a result of the pretension.

It has been shown to be particularly effective when a holding frame 1 is provided with a U-shaped blocking element 107 on both sides, as shown in FIG. 14.

The exemplary embodiment described below shows two different fixing means or devices which are used, however, in parallel and interact in a very advantageous manner.

Figure 16:
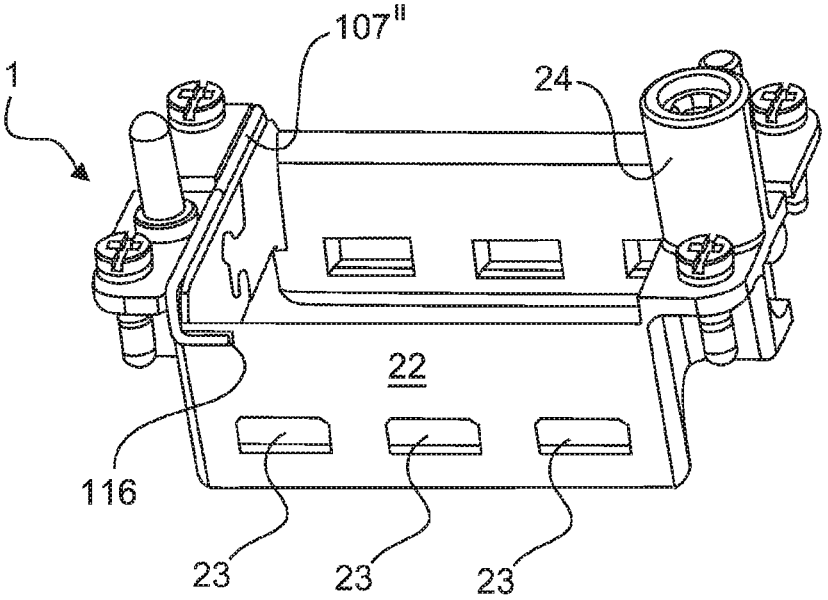
FIG. 16 shows a perspective representation of the holding frame with two types of fixing means and FIG. 17 shows a further perspective representation of the holding frame with two types of fixing means.

At least one press lug 7, which engages in recesses provided for this purpose, a first recess 9 and a second recess 10, serves as fixing means, as a result of which the holding frame is able to assume an open position and a closed position. A blocking element 107" (FIG. 16), which is inserted under pretension into recesses 116 of the side parts 22, is additionally provided here. As a result of the pretension of the blocking element 107", a force is exerted onto the flexible connection of the holding frame 1. A resultant force causes the halves 4, 5 to be positioned with respect to one another in a closed or open position.

Figure 17:
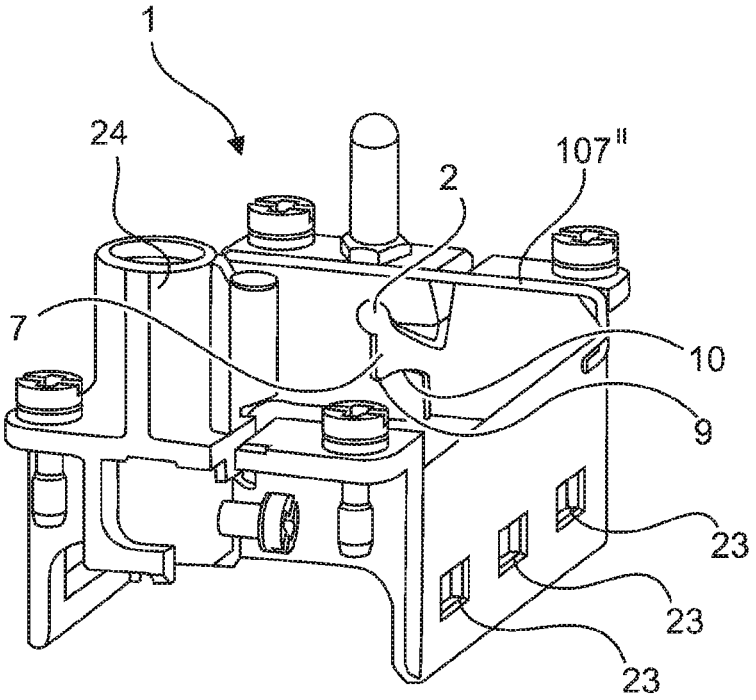

The blocking element 107" comprises or consists of a resilient wire piece which clings to the frame shape of the holding frame 1. Consequently, said embodiment is particularly to be preferred. The blocking element 107" in FIGS. 16 and 17 differs geometrically from the blocking elements 107, 107' of FIGS. 8-15. The method of operation, however, is substantially the same.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame, into which plug connector modules are insertable, wherein the holding frame comprises two interconnectable halves, a first half and a second half, wherein the halves are alignable with respect to one another in at least two positions, wherein the holding frame comprises at least one fixing means, wherein the halves are fixable with respect to one another in at least two positions by means of the at least one fixing means, wherein the holding frame comprises a pivot point at each end, and wherein a connecting line between the pivot point forms a rotational axis which extends parallel to side faces of the halves.

2. The holding frame as claimed in claim 1, wherein the fixing means is at least one blocking element and/or at least one press lug which engages in at least one recess.

3. The holding frame as claimed in claim 1, wherein the first half comprises at least one joint head and the second half comprises at least one joint receiving means which matches said joint head, wherein the joint head of the first half is engageable in the joint receiving means of the second half and, as a result, a flexible connection is provided between the halves.

4. The holding frame as claimed in claim 1, wherein the first half comprises two joint heads which are arranged on the respective end faces of the first half, and wherein the second half comprises two joint receiving means in which the joint heads of the first half are engageable.

5. The holding frame as claimed in claim 4, wherein a respective joint arm is integrally molded on each of the joint heads, and wherein the joint arms are connected to the first half.

6. The holding frame as claimed in claim 5, wherein the at least one press lug is integrally molded on the first half.

7. The holding frame as claimed in claim 6, wherein a respective press lug is integrally molded on each of the joint arms.

8. The holding frame as claimed in claim 7, wherein the second half comprises at least one respective recess on each of the two end faces, and each press lug is receivable in the at least one respective recess such that the halves are fixable in relation to one another in at least two positions, an open position and a closed position.

9. The holding frame as claimed in claim 8, wherein the second half comprises two respective recesses on each of the two end faces, and each press lug is receivable in each of the two respective recesses such that the halves are fixable in relation to one another in at least two positions, an open position and a closed position.

10. The holding frame as claimed in claim 8, wherein each press lug is pressable into the at least one respective recess.

11. The holding frame as claimed in claim 1, wherein the halves consist of metal material and, in a closed state, are in electrically conducting contact with one another.

12. The holding frame as claimed in claim 1, wherein the holding frame comprises precisely one blocking element.

13. The holding frame as claimed in claim 1, wherein the holding frame comprises a first blocking element and/or a second blocking element.

14. The holding frame as claimed in claim 1, wherein the holding frame comprises two first blocking elements or two second blocking elements.

15. The holding frame as claimed in claim 1, further comprising a blocking element having a U-shaped form with one end of the blocking element held on the first half and the other end of the blocking element held on the second half.

16. The holding frame as claimed in claim 13, wherein the first blocking element and/or the second blocking element is fastened on the halves under pretension and a force, which fixes the holding frame in an open position or in a closed position, is exerted as a result of the pretension.

17. The holding frame as claimed in claim 1, further comprising a blocking element that is meander-shaped.

18. The holding frame as claimed in claim 13, wherein the first blocking element is arranged on an end face of the holding frame and the second blocking element is arranged on the oppositely situated end face of the holding frame.

* * * * *